US007140046B2

(12) United States Patent
Ono et al.

(10) Patent No.: US 7,140,046 B2
(45) Date of Patent: Nov. 28, 2006

(54) GLOVE ADAPTED FOR USE IN FIREARMS LOADING, SHOOTING AND UNLOADING

(75) Inventors: Tosh Ono, Huntington Beach, CA (US); Scott Farmer, Napa, CA (US)

(73) Assignee: Tosh B. Ono, Huntington Beach, CA (US)

( * ) Notice: Subject to any disclaimer, the term of this patent is extended or adjusted under 35 U.S.C. 154(b) by 0 days.

(21) Appl. No.: 10/775,589

(22) Filed: Feb. 9, 2004

(65) Prior Publication Data

US 2005/0183183 A1 Aug. 25, 2005

(51) Int. Cl.
*A41D 19/00* (2006.01)

(52) U.S. Cl. ..... 2/161.5; 2/159; 2/160; 2/161.1

(58) Field of Classification Search ..... 2/20, 2/161.5, 161.1, 161.6, 163, 159
See application file for complete search history.

(56) References Cited

U.S. PATENT DOCUMENTS

| | | | | |
|---|---|---|---|---|
| 4,095,292 | A | 6/1978 | Klein | 2/161 |
| 4,197,592 | A | 4/1980 | Klein | 2/161 |
| 4,531,241 | A * | 7/1985 | Berger | 2/161.2 |
| 4,747,163 | A * | 5/1988 | Dzierson | 2/161.1 |
| 4,896,376 | A | 1/1990 | Miner | 2/19 |
| 5,117,509 | A | 6/1992 | Bowers | 2/161 |
| D336,562 | S | 6/1993 | Chin | D2/619 |
| 5,214,799 | A * | 6/1993 | Fabry | 2/161.6 |
| 5,758,365 | A | 6/1998 | Steeley | 2/161.1 |
| 5,790,980 | A * | 8/1998 | Yewer, Jr. | 2/20 |
| D445,996 | S | 8/2001 | Kiernan | D2/617 |
| 6,760,924 | B1 * | 7/2004 | Hatch et al. | 2/161.5 |

* cited by examiner

*Primary Examiner*—Katherine Moran
*Assistant Examiner*—Richale L. Haney

(57) ABSTRACT

A glove has a palmer portion and finger portions configured for placement of a base layer of the palmer portion in contact with a palm of a hand when the glove is fully engaged.

2 Claims, 2 Drawing Sheets

GLOVE ADAPTED FOR USE IN FIREARMS LOADING, SHOOTING AND UNLOADING

INCORPORATION BY REFERENCE

Applicant(s) hereby incorporate herein by reference, any and all U.S. patents and U.S. patent applications cited or referred to in this application.

BACKGROUND OF THE INVENTION

1. Field of the Invention

This invention relates generally to sports gloves and more particularly to a glove adapted to the needs of firearms sports. However, the invention is an improvement in the glove technology in general in that it folds in accordance with the mechanics of the human hand and as such is capable of application to the use of tools, gardening, automotive mechanics and a wide range of other applications.

2. Description of Related Art

The following art defines the present state of this field:

Kiernan D445,996 teaches a design for a sport glove.

Steeley, U.S. Pat. No. 5,758,365 defines a sports glove has a single-piece support insert adapted to be received therein along the top of one or more fingers, the hand and the wrist in order to provide support, protection and performance enhancement to the user. The glove is flexible so it can provide firm yet resilient support in order to maintain the support insert in place during movement. The support insert can be molded or deformed for customized fit.

Chin, U.S. D336,562 teaches a design for a sport glove.

Bowers, U.S. Pat. No. 5,117,509 defines an improved athletic glove having superior gripping properties generally comprising a palm piece and a back piece joined together to fit the human hand. The palm piece is made of a sheet of leather material prepared by a chrome tanning process or synthetic leather material having a substantially continuous layer of silicone sealant covering the palm side thereof. The layer of sealant is bonded to the palm side and does not penetrate through the palm side to the hand of a wearer.

Miner, U.S. Pat. No. 4,896,376 defines a sport glove construction and a method of using it, including fastening together sheets of plastic material by a rigid fastening device into a cup-shaped pocket configuration, forming a front ball receiving side and a rear hand receiving side having a cup-shaped pocket therein. A hand securing device is connected to the outer surface of the back side of the glove construction for proper ventilation purposes. A web device interconnects right and left portions of the front and rear sheets, to help define the pocket. Right and left elongated, resilient pads extend in a generally U-shaped configuration at the rim of the pocket, diverging away from one another at the lower portion of the sheets toward the web device. A plurality of pocket rigid fastening devices are arranged in a spaced apart manner within the pocket adjacent to the pads and secure together the front and rear sheets for helping rigidify flexibly the resulting glove construction.

Klein, U.S. Pat. No. 4,197,592 discloses an improved sport glove construction comprising connected inner and outer glove shells of different constructions, each contributing significant and desirable characteristics to the combination. The inner glove is constructed of a highly elastic, stretchable material, so constituted as to be received tightly over the entire hand of the wearer, snugly enclosing and conforming to the individual fingers and thumb, as well as the palm and back areas of the hand. The construction of the elastic inner glove shell is such as to provide a secure yet comfortable feel to the glove. The elastic inner glove is entirely enveloped by a second or outer glove of a material and construction selected to provide appropriate gripping and other characteristics. The outer glove may be of a somewhat elastic material, such as knitted fabric, but may also be of a relatively nonelastic material, such as leather, vinyl or the like, or may be a combination of materials. The inner and outer glove shells are attached in a manner permitting the necessary degree of elastic expansion of the inner glove shell relative to the outer shell when the glove is applied to the hand.

Klein, U.S. Pat. No. 4,095,292 Discloses an improved sport glove construction comprising loosely but securely connected inner and outer glove shells of different constructions, each contributing significant and desirable characteristics to the combination. The inner glove is constructed of a highly elastic, stretchable material, so constituted as to be received tightly over the entire hand of the wearer, snugly enclosing and conforming to the individual fingers and thumb, as well as the palm and back areas of the hand. The construction of the elastic inner glove shell is such as to provide a secure yet comfortable feel to the glove. The elastic inner glove is entirely enveloped by a second or outer glove of a material and construction selected to provide appropriate gripping and other characteristics. The outer glove may be of a somewhat elastic material, such as knitted fabric, but may also be of a relatively nonelastic material, such as leather, vinyl or the like, or may be a combination of materials. The inner and outer glove shells are attached securely but loosely at selected areas, to permit easy donning and doffing of the glove while at the same time accommodating the necessary degree of elastic expansion of the inner glove shell relative to the outer shell when the glove is applied to the hand.

Our prior art search with abstracts described above teaches the construction of various sports gloves, but does not teach the particular glove construction necessary to the sport involving firearms such as rifles, pistols and in particular shotguns. The present invention fulfills these needs and provides further related advantages as described in the following summary.

SUMMARY OF THE INVENTION

The present invention teaches certain benefits in construction and use which give rise to the objectives described below.

The present invention is a glove apparatus for covering at least part of one hand of the sportsman, handyman, mechanic and any other application where glove protection and use is advantageous. The present glove is highly applicable to the gun sportsman involved in firearms sport such as hunting, or sporting, i.e., target shooting, sporting clays, trap and skeet shooting, etc. In these sports it is often necessary to load and shoot continuously and quickly. This presents the problems of frictional wear on the hand due to rubbing against portions of the gun repetitively and the recoil forces resultant from firing the firearms.

The present invention addresses these issues and provides effective solutions, but should not be considered to be limited to the use of firearms.

The present inventive glove is a flexible hand enclosure defining a palmer portion and finger portions configured for placement of a base layer of the palmer portion in contact with a palm of a sportsman's hand when the glove is fully engaged. A topper layer of the palmer portion is fixedly engaged over the base layer with a resilient pad engaged between the base and topper layers. The resilient pad is outlined by a first stitching of elongated oval shape, and is parted by a second, approximately linear stitching extending at a angle across the palmer portion. The linear stitching is positioned in correspondence to a lateral fold in the palm of the sportsman's hand. In use, the sports glove provides cushioning so as to absorb some of the energy released during firearm recoil. The glove also provides reinforcement to prevent early wear-out due to friction on parts of the firearms during shell loading and unloading.

A primary objective of the present invention is to provide an apparatus and method of use of such apparatus that yields advantages not taught by the prior art.

Another objective is to provide such an invention capable of adapting to the human hand ergonomically.

A further objective is to provide such an invention capable of durable wear in handling and using firearms, tools, implements and other uses.

A still further objective is to provide such an invention capable of absorbing forces transmitted to the hand, such as the recoil force when using firearms or the forces transmitted when using a sporting apparatus such as a baseball bat, or the forces felt in a hand using a hammer.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

Figure 1:
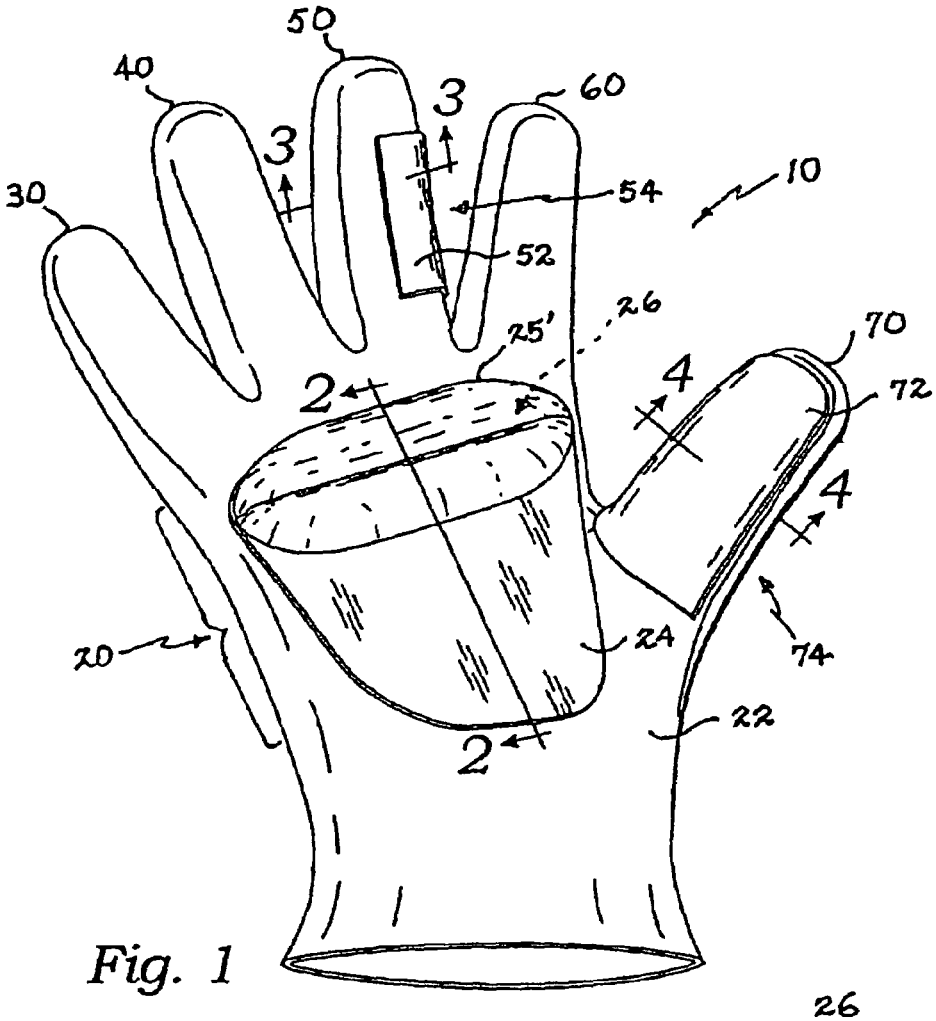
FIG. 1 is a plan view of the present invention showing a palmer portion.
Figure 2:
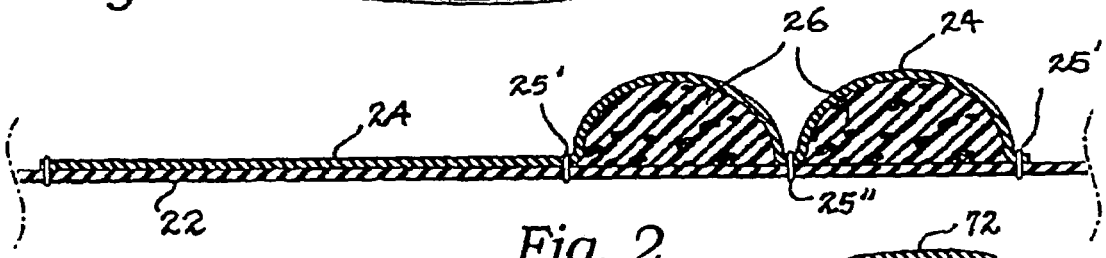
FIG. 2 is sectional view thereof taken along line 2—2 in FIG. 1.

The present invention glove apparatus 10 comprises, a flexible hand enclosure defining a palmer portion 20, finger portions 30–60 and thumb portion 70, which are extensive as extremities therefrom. The apparatus 10 is preferably made by sewing portions of subtle leather or similar materials as is known in the art. Of course the glove 10 may have fewer fingers than five, but a full glove seems to provide an improved solution to the basic problems that arise in handling, loading, firing and unloading firearms. The extremities of the glove 30–70 and palmer 20 portions are preferably configured for placement of a base layer 22 (FIG. 2) of the palmer portion 20 in contact with a palm of the sportsman's hand when the finger and thumb portions 30–70 are fully engaged with fingers of the sportsman's hand. A topper layer of the palmer portion 20 is fixedly engaged over the base layer 22 and extends preferably over the entire palmer portion of the glove 10 extensive toward the wrist, as is shown in FIG. 1.

A resilient pad 26 of so-called, memory foam, is fixedly engaged between the base layer 22 and the topper layer 24. The resilient pad 26 is outlined by a first stitching 25' of elongated oval shape that covers the upper padded portion of the palm of the hand, extends to the central portion of the palm of the hand, and is parted, preferably bifurcated, by a second, approximately linear, stitching 25" extending at a angle across the palmer portion 20, the linear stitching 25" positioned in correspondence the major one of the natural folds of the palm of the human hand, preferably the distal transverse crease which is positioned on the palm just below the heads of the metacarpals and the level of the metacarpophalangeal joints, so that the resilient pad 26 is able to fold, as well, into a compact but not compressed form, conforming to the folded attitude of the hand as it grips the stock 80 of the firearm (FIGS. 5 and 6), and thus is able to absorb a great deal of the recoil shock of the firearm as it moves with impulse back against the glove 10 upon firing. In referring to fixing of one layer of the glove 20 over another layer of the glove 20 herein, what is preferably meant is stitching of the layers together, however other forms of fixing such as bonding, thermal sealing and so forth may be used, as would be known by those of skill in the art.

Figure 3:
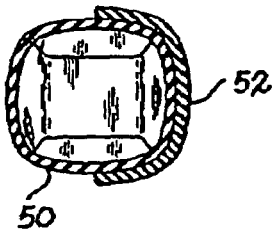
FIG. 3 is sectional view thereof taken along line 3—3 in FIG. 1.

The extremities of the glove apparatus 10 preferably includes a middle finger portion 50 which has a first reinforcing layer 52, essentially a patch, fixedly positioned over the middle finger portion 50 and extensive to cover at least a medial portion or area 54 of the middle finger 50 and is, in the least, positioned on the side of the middle finger 50 that is adjacent to the index finger 60, although the layer 52 may be further extensive as necessary or desired. This is clearly illustrated in FIGS. 1 and 3 of the drawings.

Figure 4:
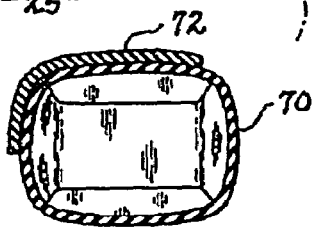
FIG. 4 is sectional view thereof taken along line 4—4 in FIG. 1.

Preferably, the thumb portion 70 of the glove 10 provides a second reinforcing layer 72, of similar type to that of the layer 52 described above, that is fixedly positioned over at least a palmer side 74 of the thumb portion 70, that is, the layer 72 is positioned to so that it will contact the palmer portion 20 of the glove 10 when the thumb portion 70 is folded into contact with the palmer portion 20. This is clearly illustrated in FIGS. 1 and 4 of the drawings.

Figure 5:
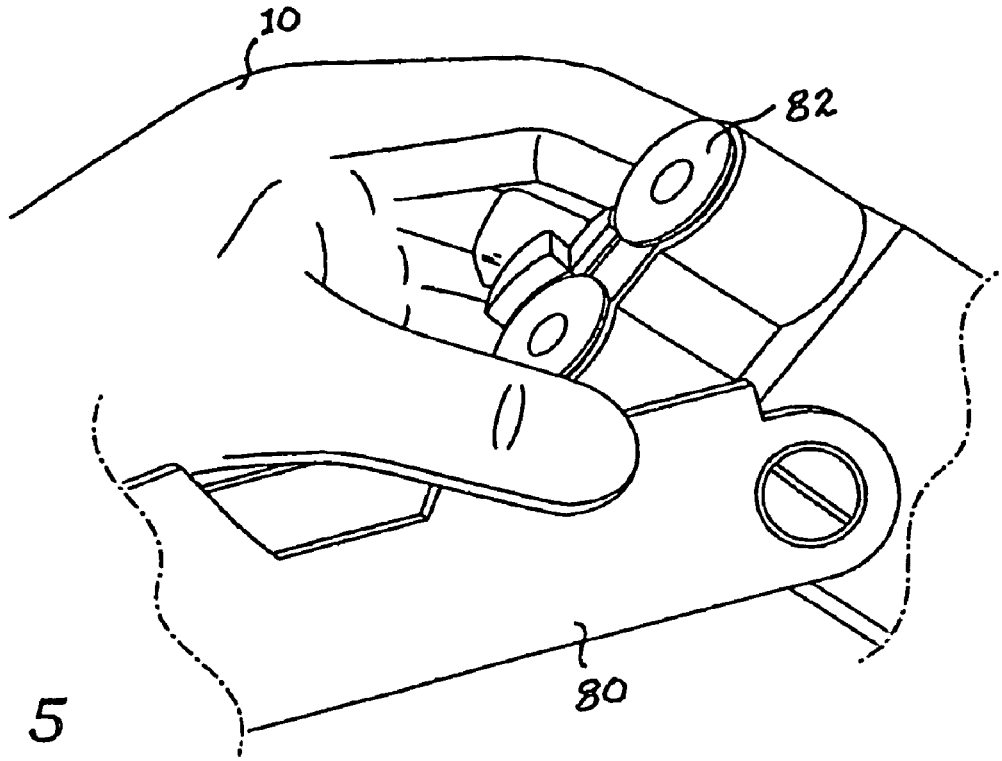
FIG. 5 is a perspective view thereof showing placement of the invention upon reaching to extract shells from a firearm in one application of the invention.
Figure 6:
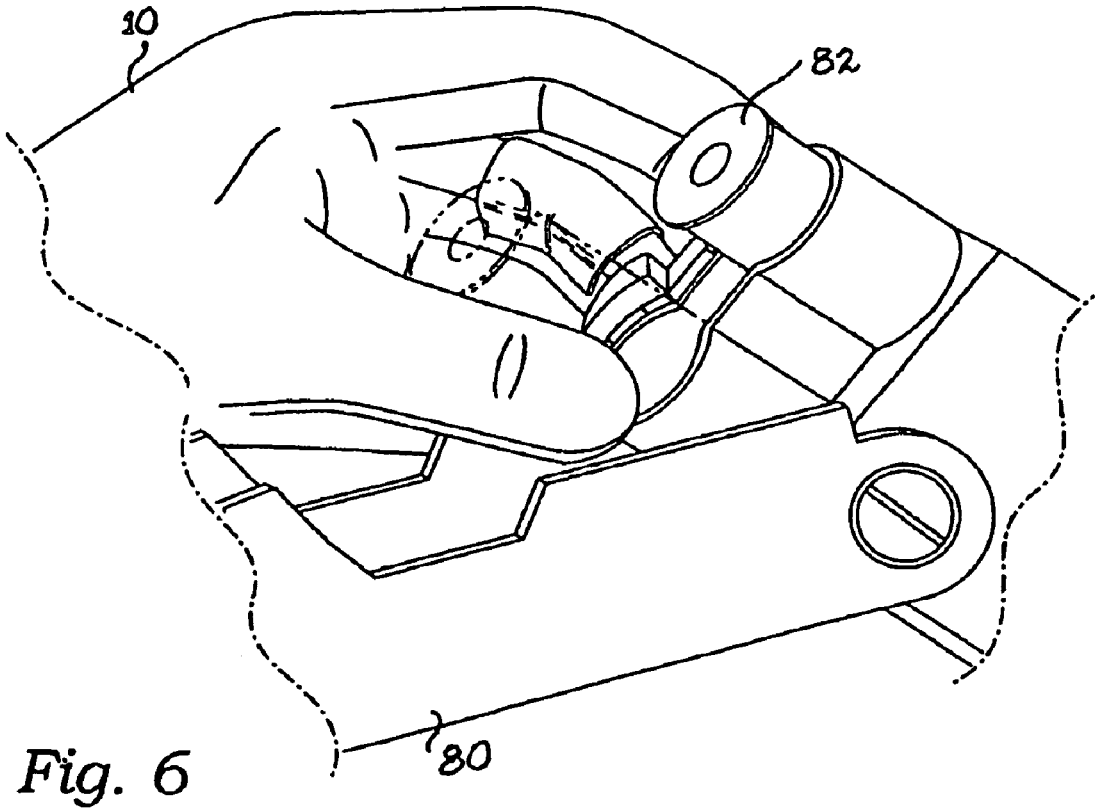
FIG. 6 is a perspective view thereof showing the withdrawal of spent shells.

As can be seen in FIGS. 5 and 6, the middle finger portion 50 and the thumb portion 70 are positioned for frictional wear contact with the firearm during loading and unloading of shells 82 and especially for wear contact against shell ejectors which rub against the middle finger during unloading as shown in FIG. 6.

The enablements described in detail above are considered novel over the prior art of record and are considered critical to the operation of the instant invention and to the achievement of the above described objectives. The words used in this specification to describe the invention and its various embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of this described invention and its various embodiments are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments below or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A glove apparatus comprising: a flexible hand enclosure, the hand enclosure defining a palmer portion, a back portion, a wrist portion, and at least one finger portion; wherein the at least one finger portion of the glove apparatus includes a middle finger portion, the middle finger portion providing a first reinforcing layer fixedly attached to the base layer in a position over the middle finger portion and extensive so as to cover at least a medial portion of the middle finger and a portion of a side of the middle finger between an index finger and the middle finger, the palmer portion further comprising a base layer positioned for contact with a palm of a human hand; a topper layer fixedly engaged over the base layer; a single resilient pad engaged between the base layer and the topper layer, the resilient pad outlined by a first stitching creating an elongated oval shape, the topper layer extending past the resilient pad in the direction of the wrist portion and covering a substantial portion of the palm; wherein the extended portion of the topper layer is fixedly secured directly to the base layer of the glove, and the resilient pad is bifurcated by an approximately linear stitching extending across the palmer portion in correspondence to the distal transverse crease in the palm of the human hand to form two ergonomically convex structures that are substantially similar in size and extend laterally across the metacarpals.

2. The apparatus of claim 1, further comprising a thumb portion; the thumb portion providing a second reinforcing layer fixedly positioned over at least a palmer side of the thumb portion and extends to a side portion of the thumb finger between the thumb and index finger.

* * * * *